United States Patent [19]

Wiechmann

[11] 4,407,438

[45] Oct. 4, 1983

[54] TRANSPORT SYSTEM FOR FLAT METALLIC MATERIALS IN STRIP MILLS

[75] Inventor: Karl-Ernst Wiechmann, Bremen, Fed. Rep. of Germany

[73] Assignee: Klöckner-Werke Aktiengesellschaft, Duisburg, Fed. Rep. of Germany

[21] Appl. No.: 282,649

[22] Filed: Jul. 13, 1981

[30] Foreign Application Priority Data

Jul. 16, 1980 [DE] Fed. Rep. of Germany ..... 3026891
Jun. 4, 1981 [DE] Fed. Rep. of Germany ..... 3122196

[51] Int. Cl.[3] ..... B65H 25/26; B21C 47/34; B65G 54/02

[52] U.S. Cl. ..... 226/15; 226/20; 72/250

[58] Field of Search ..... 226/192, 15, 16, 17, 226/18, 19, 20, 3; 242/78.1; 72/250

[56] References Cited

U.S. PATENT DOCUMENTS

| | | | |
|---|---|---|---|
| 3,001,680 | 9/1961 | Nitkiewicz | 226/15 |
| 3,240,043 | 3/1966 | Siegeo | 242/78.1 X |
| 3,254,300 | 5/1966 | Prell | 226/20 X |
| 3,942,697 | 3/1976 | Neumann | 226/192 |
| 4,054,251 | 10/1977 | Henderson | 226/15 |

OTHER PUBLICATIONS

"Der Linearmotor in der Antriebstechnik" in Techn. Mitt. Aeg-telefunken 69(1979) 3, pp. 65-73.

"Erste Aluminum-Tandemstrasse mit Temperaturmodell und Automatischer Einfädelung" in Ideas for Steel, 1/80.

*Primary Examiner*—Stuart S. Levy
*Assistant Examiner*—Lloyd D. Doigan
*Attorney, Agent, or Firm*—Watson, Cole, Grindle & Watson

[57] ABSTRACT

A transport system for flat metallic materials such as thin, hot-rolled metallic strips in a strip mill includes a roll table and one or more linear drive elements which are positioned between a pair of rollers of the roll table and below the table plane formed thereby to exert a travelling force field on the leading end of the flat metallic material passing thereover which will have a force component directed perpendicularly to the direction of movement of the flat metallic material and thus act to adjust (i.e. center) the positioning of the moving metallic material on the roll table. The linear drive elements may include heat shields and cooling fluid discharge openings.

16 Claims, 10 Drawing Figures

TRANSPORT SYSTEM FOR FLAT METALLIC MATERIALS IN STRIP MILLS

BACKGROUND OF THE INVENTION

1. Field of the Invention

The present invention relates to systems which transport flat materials such as metallic strips through strip mills, and more particularly to such systems which include devices for controlling the direction of travel of these flat materials as they move towards the strip mill coilers.

2. The Prior Art

Metallic strip materials are conventionally fabricated in strip mills by a process which includes heating the slab of metallic material from which the strips are to be made in a furnace, finish rolling the slabs to form the metallic strips in a mill train, and winding the strips on a coiler which is positioned at the end of the mill train. A feed guide is normally positioned in front of the coiler so as to center the leading end of the metallic strip as it approaches the reeling mandrel of the coiler. The feed guide is important because if the leading end of the metallic strip is not properly positioned as it contacts the reeling mandrel, it will not be properly wound around the coiler.

Conventional feed guides include two guide boards which are adjusted to form a funnel-shaped space therebetween so as to direct a metallic strip entering its wider end in exact fashion towards the reeling mandrel. These feed guides have been quite satisfactory when dealing with relatively thick hot-rolled metallic strips. However, when the hot-rolled strips are relatively thin, e.g., less than 2.5 mm in thickness, the feed guides may not properly act to center the strip. In this regard, hot-rolled metallic strips which are relatively thin may not have a uniform thickness when they leave the roll stands and the leading end may be curved out of the plane of the remainder of the strip (this portion being called the "initial curve" of the strip). In addition, the thin hot-rolled strips may easily become displaced from the center of the rollers over which they pass towards the feed guide, and, if too far off-center at the point of their entry into the funnel-shaped space in the feed guide such that their leading end impacts at an angle against the guide boards, their leading end, instead of being shifted in position, will flip over. The remainder of the strip material, being nevertheless pushed forward, will thereafter become folded in an accordion-like fashion. All of this strip material will thus become unusable. Further, since modern strip mills operate at very high rolling speeds, the following strips may become damaged as well, requiring their being also discarded. Obviously this waste is quite uneconomical.

Thus, it is an object of the present invention to provide an improved transport system for conveying flat materials, e.g., thin hot-rolled metallic strips, through a strip mill wherein the direction of movement of the leading end of the flat material (and thus the entire piece of flat material) can be effectively adjusted.

SUMMARY OF THE INVENTION

According to the present invention the transport system will include a roll table comprised of a multiplicity of aligned rollers, and at least one linear drive element positioned between at least one pair of rollers, each linear drive element being capable of creating a force in the leading end of the flat material, e.g., the thin hot-rolled metallic strip passing thereover, so as to move it laterally with respect to its initial direction of motion and thus act to center the material on the roll table. Each drive element will be located below the table plane formed by the upper peripheries of the rollers of the roll table so that it will be in non-contacting relationship to the material passing thereover. Each linear drive element will in fact create a force on the leading end of the material which will be directed at an angle to the material's initial direction of movement such that a component of the force will act on the material to move it in a direction normal to its initial direction of movement, thereby functioning to shift the material to the center of the roll table.

The linear drive elements used in the present invention are well known. In operating principle they correspond to conventional travelling-field motors in which the stator is "cut open" and is arranged in a plane. Further details of such linear drive elements can be found in the article by Gerhard Kratz entitled "Der Linearmotor in der Antriebstechnik" in Techn. Mitt. AEG:-TELEFUNKEN 69(1979) 3, pages 65-73.

It is quite important to note that because the linear drive elements used in the transport system of the present invention are oriented with respect to the rollers of a roller table in which they are used such that their generated travelling forces will tend to move a thin metallic strip passing thereover in a lateral direction, the inventive transport system is quite different from the one disclosed in the article entitled "Erste Aluminum-Tandemstrasse mit Temperaturmodell und automatischer Einfädelung" in Ideas for Steel, January 1980, wherein linear drive elements are used in an aluminum mill to prevent aluminum foil strips from wrinkling as they enter the mill stands. In this system the linear drive elements are oriented with respect to the aluminum foil strips such that their travelling fields are parallel (no perpendicular component) to the initial direction of foil movement.

In a first embodiment of the present invention a single linear drive element is centrally positioned between a pair of rollers of a roll table so as to be oriented in parallel with the rollers and below the table plane formed by their upper peripheries. The linear drive element is connected to a power supply which is capable of passing current to the linear drive element in opposite directions, thus enabling the linear drive element to create a traveling field in one lateral direction of the roll table or the other. The leading end of a hot-rolled metallic strip passing over the rollers of the roll table in off-center fashion to a center line therethrough can be acted upon by the travelling field of the linear drive element to move it laterally into centering alignment with the table center line. Advantageously, a sensing device which is located ahead of the linear drive element can be used to suitably control the power supply after sensing the position of the leading end of the hot-rolled metallic strip on the roll table. The sensing device can be an opto-electric detector which is capable of sensing edges of moving metallic strips.

In a second embodiment of the present invention two linear drive elements are positioned between pairs of rollers of the roll table, one element being located on one side of the center line of the roll table and the other element being located on the other side. These linear drive elements are connected to a power supply which operates to energize each in only one fashion, i.e., such that when activated each linear drive element will generate a traveling force field directed towards the center line of the roll table.

The linear drive elements of the invention will advantageously be mounted on guides such that, as desired, one linear drive element can be positioned between a pair of rollers (in accordance with the first noted embodiment of the present invention) or else two linear drive elements can be positioned between the same pair of rollers (in accordance with the second noted embodiment of the present invention). In addition, if two linear drive elements are used, the guides allow for them to be easily adjusted in position with respect to one another and accomodate any width of material passing thereover.

Since hot-rolled metallic strips passing through a strip mill will have high temperatures, it is desirable that the linear drive elements in the system of the present invention be protected from this heat. Thus, the linear drive elements can be constructed to include a heat-insulating cover plate between it and the hot-rolled strip passing thereover, the material forming the cover plate being not only heat resistant but wear-resistant, and both magnetically and electrically insulating as well. The wear resistance property is important in order to protect the linear drive element from mechanical impact from the hot-rolled metallic strip, the leading end of which may fall below the roll table plane due to reciprocating forces acting thereon by the linear drive elements or else as a result of mechanical vibrations or the like. Because the cover plate will also be magnetically and electrically insulating, the travelling fields generated by the linear drive elements will not apply forces to the cover plate which would tend to move them. Electrical shorts with the adjacent rollers can be thus avoided even during rough operating conditions.

During normal operations of strip mills both thin and thick hot-rolled strips will be passed therethrough on an irregular basis. When the transport system of the present invention is used, the linear drive elements will be switched off (no power supplied thereto) when the thicker strips are passed thereover because (as noted previously) conventional feed guides are adequate to control their direction of movement. However, the heat stress from these thicker hot-rolled strips is considerably greater than that from the thinner hot-rolled strips. For this reason, in still another embodiment of the invention, cooling passages are formed between the groove-closure wedges of the linear drive elements can be reduced still further. These cooling passages will also help the conventional cooling circuits dissipate a considerable portion of the generated heat from the linear drive elements which is produced when the travelling fields are generated.

In principle, the linear drive elements can be electrically energized from a high-voltage line through series-connected transformers. However, when the travelling fields are generated, considerable inductive idle power occurs, so that such a simplified circuit would lead to considerable difficulties in terms of its design. For this reason, in a further embodiment of the invention, a device is provided for the capacitive compensation of the inductive idle power of the linear drives.

The inventive transport system can in fact be used to transport any type of flat material with sufficiently large thrust surfaces facing the linear drive elements. Thus, in the sense of the invention, flat material is understood to mean not only hot-rolled strip and cold-rolled strip that has been rolled in strip sheet mills, but also slabs and generally widearea goods to be conveyed which are electrically conducting and have at least one substantially flat side turned towards the roll table or towards the linear drive elements, as the case may be. Such flat materials may be made of steel, copper, aluminum, magnesium, and the like. They may also be magnetizable.

Strip mills in the sense of the invention are not only hot strip mills and cold strip mills but any type of metallurgical plants which have roll tables with drives. Auxiliary equipment is understood to include cooling beds, stacking equipment, dividing systems, inspection lines to and from which the flat material is transported in a manner that is in itself known and/or additionally or exclusively by means of linear drive elements.

In general, strip mills are used for various flat materials: thin or thick hot-or cold-rolled strips other than steel, aluminum, magnesium. In addition, the treatment of certain materials requires the use of agents such as lubricating and/or protective films. For example, in the case of magnesium, a protective film of kerosene must be provided.

As already mentioned, switched-off linear drive elements must be protected against the radiant heat from flat material with a large heat capacity. Care must also be taken that the material does not slip along the linear drive elements. In the case of thin, suspended strips, this can cause slippage tracks on the surface of the strip and considerable wear on the linear drive elements.

Thus, another object of the invention is to design transport system with linear drive elements for strip mills in such a way that no damage is inflicted upon the linear drive elements, whether through thermal or mechanical stress.

This object is achieved, according to the invention, by using a device situated in the area of the linear drive element on the entry side of the flat material for producing a coolant cushion for the linear drive element and/or a sliding and/or protective cushion for the flat material, using a gaseous or liquid medium. The result of this measure is that, when the flat material has a large heat capacity, for example, when heavy strips are run through the strip mill, a coolant cushion is produced between the linear drive element and that side of the flat material that is turned towards it. This coolant cushion absorbs a considerable portion of radiant heat given off by the flat material and dissipates it. At the same time, the cushion equalizes the small level difference between the plane of the roll table and the plane forms by the linear drive elements.

According to the invention, th coolant cushion may consist of water, steam, air, or another liquid or gaseous medium, such as kerosene or nitrogen. The sliding and/or protecting cushion for the flat material may consist of water, air, oil, an emulsion, or an inert gas. A liquid cushion primarily has the advantage that the spring action of heavy strip material on the linear drive elements is dampened. With thin hot-rolled strip, the same effect can be attained by a gaseous medium, which then additionally forms a protective gas atmosphere. The cushion for the flat material may also have a pure sliding function, it may have an additional protective function and, in the latter case, it prevents scratches from occurring, e.g., on the sensitive surfaces of thin hot-rolled strip.

According to the invention, the equipment may give off a liquid medium, which evaporates in the area between the flat material and the linear drive element, so that a considerable portion of the radiant heat is used up for the heat of vaporization. The equipment may, for example, give off water for this purpose. The formation of a sliding cushion is important when linear drive elements are provided in place of one or more rollers of the roll table of the strip mill, so that in this area a rolling transport of the flat material is possible. The gas or liquid medium forms a sliding cushion according to the aqua-planning principle. Especially with thin hot-rolled strips, this medium has the object of preventing the hot-rolled strips from contacting the surface of the linear drive elements during their transport, as a consequence of the constantly present spring action. This would lead to the formation of flutes or scratches on the surface of the strip material. As is well known, such strips would then no longer be usable for further processing, e.g., in the automobile industry, and would have to be rejected.

According to the invention, the noted device has a covering with outlet openings for the liquid or gaseous medium, the covering being situated in the plane of the cover plate of the linear drive element. Care must be taken that, on the one hand, a sufficiently strong cushion is formed and, on the other hand, the medium does not cool the flat material in such a way as to influence its grain structure.

In order to achieve uniformity in the generation of the cushion according to the invention, in another embodiment the axes of the outlet openings to the surface of the covering are slanted so that the flat material, through its motion, pulls the medium into the region between the underside of the material as well as of the cover plate and of the covering. The result of this embodiment is that the gaseous or liquid medium between the underside of the flat material and the linear drive element is to be fed only on the entry side of the flat material. Through the motion of the material, this liquid or gaseous medium is sucked into the gap between the flat material and the linear drive element.

According to another advantageous embodiment of the invention, the covering is integrated into the cover plate of the linear drive element and results in the creation of a constructional unit.

According to still another advantageous embodiment of the invention, the covering has a bevel on the entry side of the flat material to deflect the edge of the flat material in the direction of transport. Thus, in the case of a possible spring action of the incoming flat material (ski formation) a backup of flat material cannot occur.

In yet another embodiment of the invention, the covering and the linear drive element are designed as a liftable and lowerable unit. This is especially of advantage when, for example, during the transport of heavy material, the use of the linear drive elements must be dispensed with and care must be taken that the incoming leading edge of the material does not damage the linear drive element and the covering.

The invention will now be better understood by reference to the attached drawings taken in conjunction with the following discussion.

DETAILED DESCRIPTION OF THE PREFERRED EMBODIMENTS

Figure 1A:
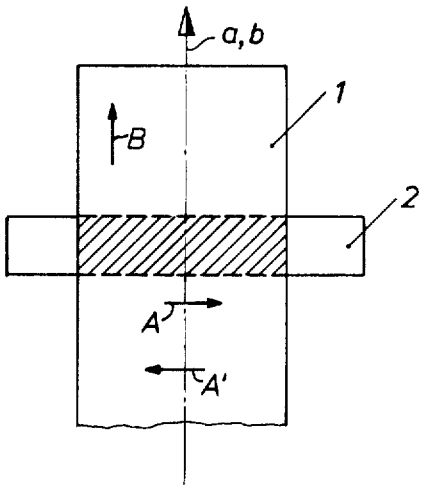
FIGS. 1*a*, 1*b* and 1*c* depict the forces which can be exerted on the leading end of a thin hot-rolled metallic strip when passing over a transport system according to the first and second embodiments of the present invention.

The principle of operation of the first embodiment of transport system according to the present invention can be appreciated from a review of FIG. 1*a*. The leading section of the hot-rolled strip is labeled 1 and it is being transported on a roll table (not shown) in the direction of the arrow a, b to the feeding guide (likewise not shown) of the coilers. As shown schematically, a linear drive element 2 is situated below the hot-rolled strip. This linear drive element can generate a travelling field which is perpendicular to the direction of movement of the hot-rolled strip, schematically shown by the arrow B. The travelling field is directed either toward the arrow A or oppositely in the direction of the arrow A'. The forces exerted by the linear drive element on the hot-rolled strip are proportional to the surface of the linear drive element which is covered by the strip. This covered surface is shown hatched. It is apparent from FIG. 1*a* that, when the travelling field is activated, a force is always exerted on the hot-rolled strip independent of whether or not the strip is aligned centrically to the center line of the roll table, which is likewise indicated by the arrow a, b. For this reason, additional devices for sensing the position of the leading section of the hot-rolled strip are necessary, which devices will be described in more detail below. In FIG. 1*a*, the winding of the linear drive element is so designed and arranged that the travelling fields run perpendicularly to the direction of transportation of the hot-rolled strip.

Figure 1B:
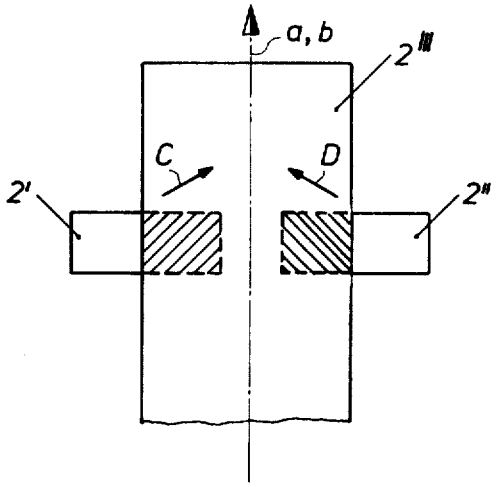
Figure 1C:
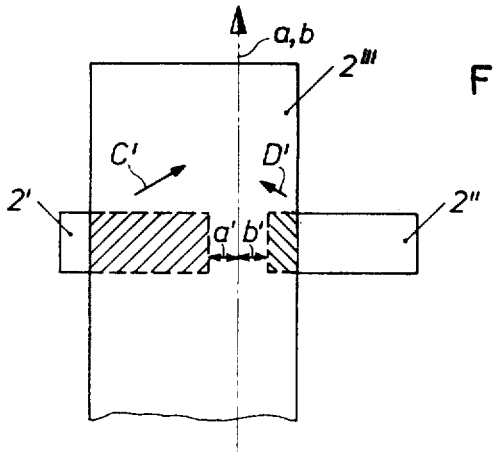

FIGS. 1*b* and 1*c* are used to explain the principles of operation of the second embodiment of the invention. The center line of the roll table, as well as the direction of transportation of the hot-rolled strip, is likewise schematically shown by the arrow a, b. The two linear elements 2' and 2'' of a pair are situated underneath the hot-rolled strip at the same distance from the center line of the roll table (arrow a, b). The different hatching of the surfaces of the linear drive elements 2' and 2'', which are covered by the hot-rolled strip, indicates schematically that the travelling fields of these two linear drive elements do not run in the same direction, i.e., in the ideal case they are directed oppositely. Each linear drive element applies a thrust load to the hot-rolled strip 2'', the thrust of the linear drive element 2' being designated by C and that of the linear drive element 2" by D. Both thrusts always have a component in a direction normal to the center line and a component in the direction of transportation. When the hot-rolled strip is arranged symmetrically with respect to the center line of the roll table, thrusts of equal magnitude are exerted on the strip which correspond to the equally large covered surfaces of the two linear drives. If the strip runs off-center, as shown in FIG. 1*c*, the covered surfaces have a different size, so that, as shown in FIG. 1*c*, the linear drive element 2' exerts a stronger thrust C' than the linear drive element 2", which exerts a thrust D'. Accordingly, a resultant thrust with a focussing action is exerted on the hot-rolled strip in such a way that the first section of the strip is centered, i.e., focussed, onto the middle of the roll table. The result of this is that the first section of the strip is always centered or focussed into the middle of the roll table automatically and without additional auxiliary equipment, if the distances a' and b' of the two linear drive elements 2' and 2" from the center line a, b are equal. Accordingly, by arranging these two linear drive elements so that they can be slidably guided, it is possible to adjust them in such a way that they exert a focussing thrust on the strip towards the center of the roller table.

Figure 2:
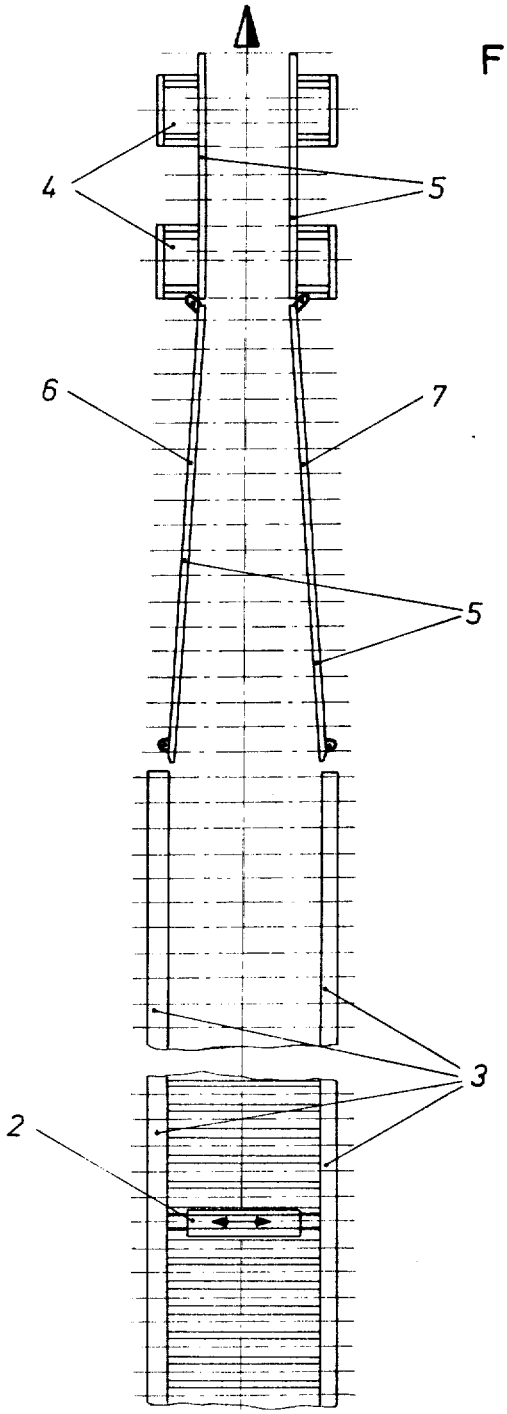
FIG. 2 shows a schematic top view of a transport system in the form of a rolling mill according to the first embodiment of the present invention.

FIG. 2 is a schematic top view of a transport system in the form of a strip mill with a built-in linear drive element. The roll table is denoted by 3, and a linear drive element, arranged as in FIG. 1*a*, is designated by 2. A feed guide 5 is arranged at the end of the strip mill, in front of the coilers 4. The feed guide 5 has the two converging guide boards 6 and 7, which create a funnel-like passageway therethrough in the direction of the coilers 4.

Figure 3:
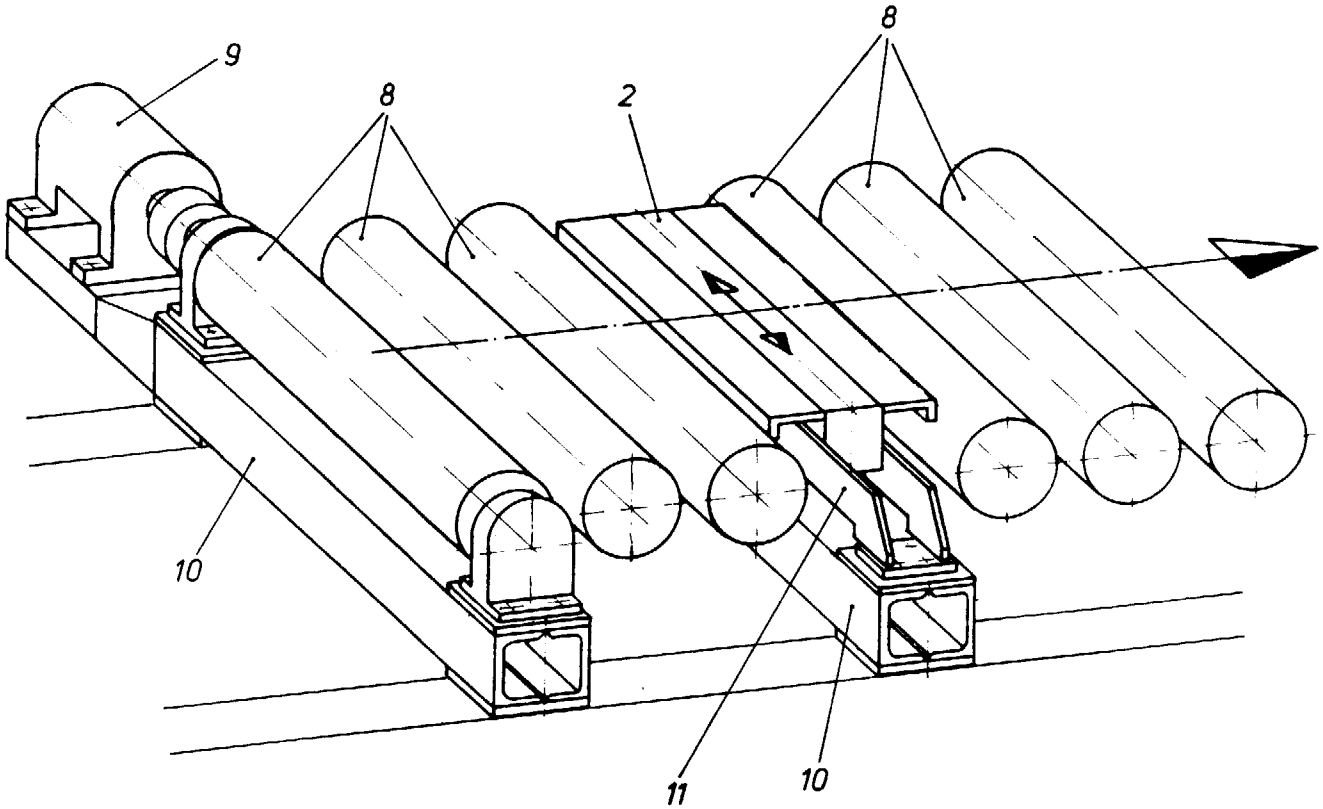
FIG. 3 shows a perspective view of the portion of FIG. 2 which includes the linear drive element.

FIG. 3 is a perspective view of the portion of the transport system which includes the linear drive element 2. The rollers of the roll table, which are driven by the electric motors 9 (only one of which is shown), are designated by 8. The rollers are mounted in pillow blocks placed on a section 10. As can be seen from FIG. 2, in place of one of the rollers, a linear drive element 2 is arranged on the section 10. The linear drive element 2 is slidably guided in a guide 11 arranged on the section 10 so that it can move in a direction parallel to the direction of the roller axes. Depending on the excitation of the travelling field, a transverse thrust in one or the other direction perpendicular to the direction of transportation is exerted on a thin hot-rolled strip (not shown). This is schematically represented by the double arrow and, in the present case, the direction of the transverse thrust makes an angle less than 90° with the direction of transportation of the hot-rolled strip (not shown).

Figure 4:
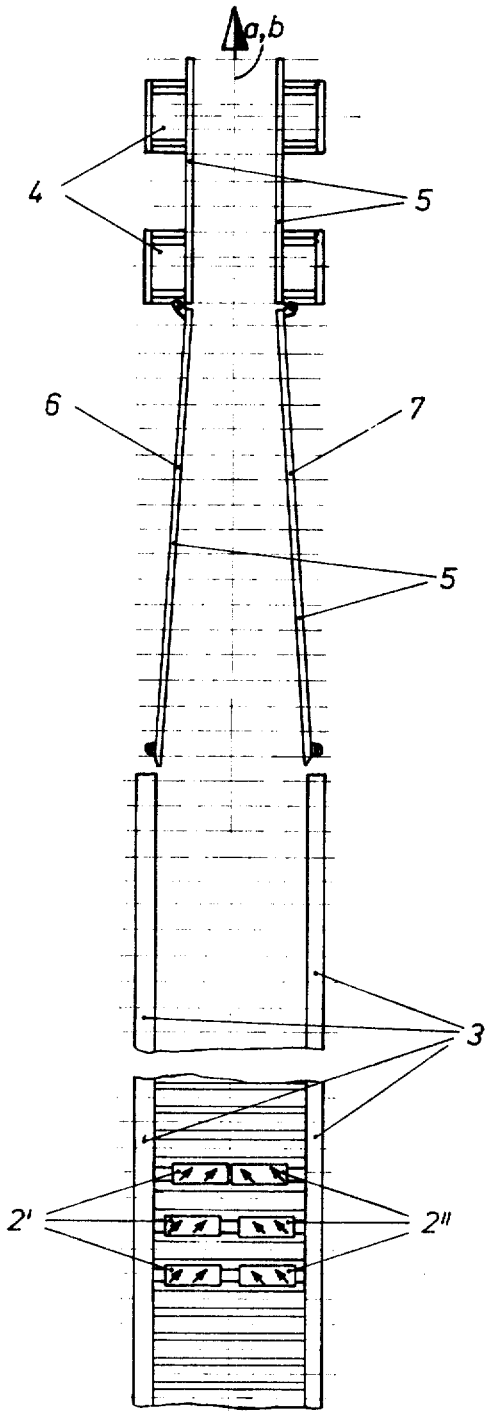
FIG. 4 shows a schematic top view of a transport system in the form of a rolling mill according to the second embodiment of the present invention.

Like FIG. 2, FIG. 4 is a top view of the transport system of a rolling mill where, in place of a linear drive element 2 between the rollers of the roll table, three pairs of linear drive elements 2', 2" are arranged as in FIGS. 1*b* and 1*c*. The linear drive elements of each pair are spaced the same distance from the center line a, b of the roll table, and the distances of the pairs to this center line differ from one another. Like parts are denoted by like reference symbols. The windings of the linear drive elements of each pair are designed and connected so that thrust components are generated in the direction of the drawn-in arrows.

Figure 5:
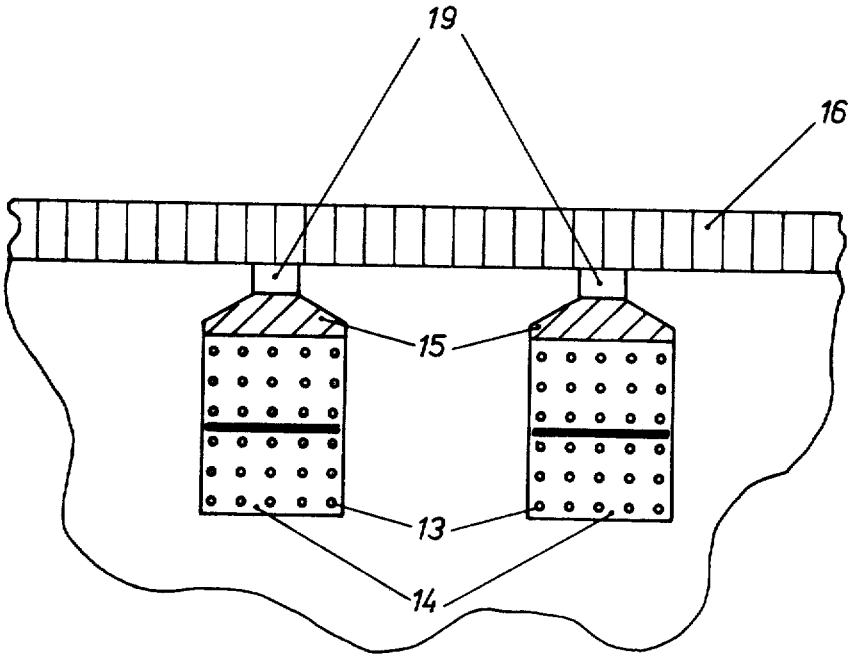
FIG. 5 shows a cross sectional view of a linear drive element as used in either FIGS. 3 or 4.

FIG. 5 shows a cross section through a linear drive element according to the first or second embodiments (FIG. 3 or FIG. 4). The winding, which is arranged in the grooves 14, is designated by 13. These grooves are closed in the direction of the strip by so-called groove-closing wedges 15. A cover plate 16 is situated thereabove and consists of a highly wear-resistant material, which also serves as a magnetic and electric insulator. Additional cooling passages 19 are formed between the cover plates and the groove-closing wedges. The arrangement of the linear drives is such that the surface of these cover plates runs below the plane of the strip which is contacted by the rollers.

Figure 6:
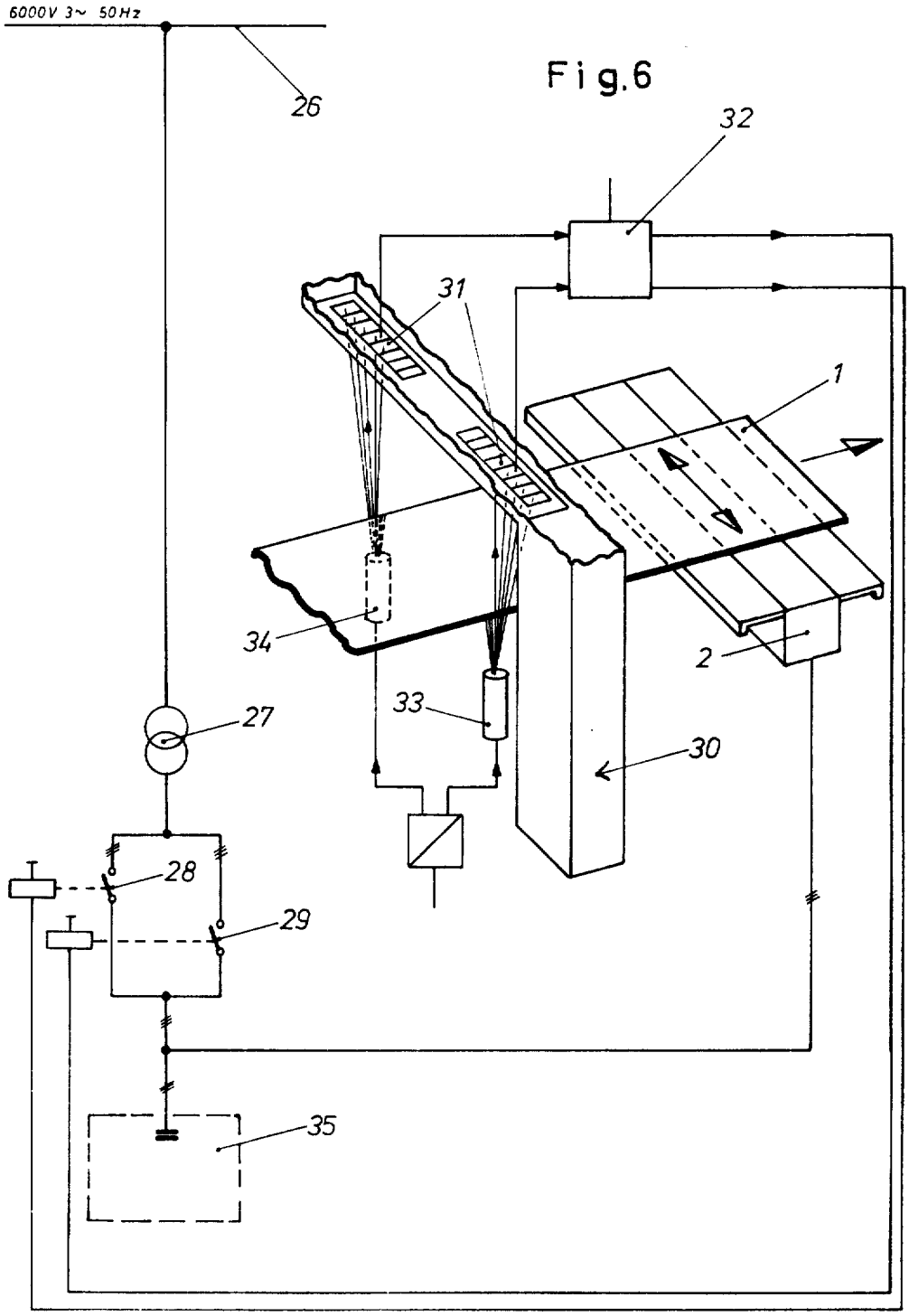
FIG. 6 shows a schematic view of a portion of a transport system according to the present invention with connected power supply and control system.

FIG. 6 shows a functional diagram for the arrangement of the linear drive elements according to the first embodiment, with the linear drive elements (the direction of the travelling fields is prescribed) being controlled by scanning the edges of the hot-rolled strip 1. A linear drive element, designated by 2, is so designed and arranged that the direction of the two travelling fields points perpendicularly to the direction of transportation (cf. FIG. 3). For the sake of clarity, the rollers and the coilers are not drawn in. The power supply for the linear drive element comes from a high-voltage line 26, which feeds a transformer 27. The reversal of direction of the travelling field of the linear drive is accomplished through the right-left switching device 28, 29 which is activated by the strip-edge control 30 in a manner in itself known. This strip-edge control consists of the photo diodes (detectors) 31 arranged in a row normal to the direction of the hot-rolled strip and the outputs of which are routed to an evaluation circuit 32 and which control the devices 28, 29 as a function of the direction. The light sources 33 and 34 are arranged as transmitters in the area of the strip edges underneath the plane of the strip. Depending on the position of the strip, the corresponding photo diodes are irradiated, so that their output signals are a measure for the alignment or centering of the hot-rolled strip. As apparent from FIG. 5, this strip-edge control is arranged at a prescribed minimum distance from the respective linear drive element, as viewed in the direction of transportation, so that the response times and the like of the entire equipment are taken into consideration. In addition, to compensate for the inductive idle power, an appropriate reactive-load compensation device 35 is provided essentially consisting of a capacitor battery and connected in series with the transformer and with the changeover facilities together with the linear drive elements.

To save energy and to better control the cooling problems, the linear drive elements may work intermittently. In this case, after the strip end has run through, the linear drive elements concerned may again be switched off.

Figure 7:
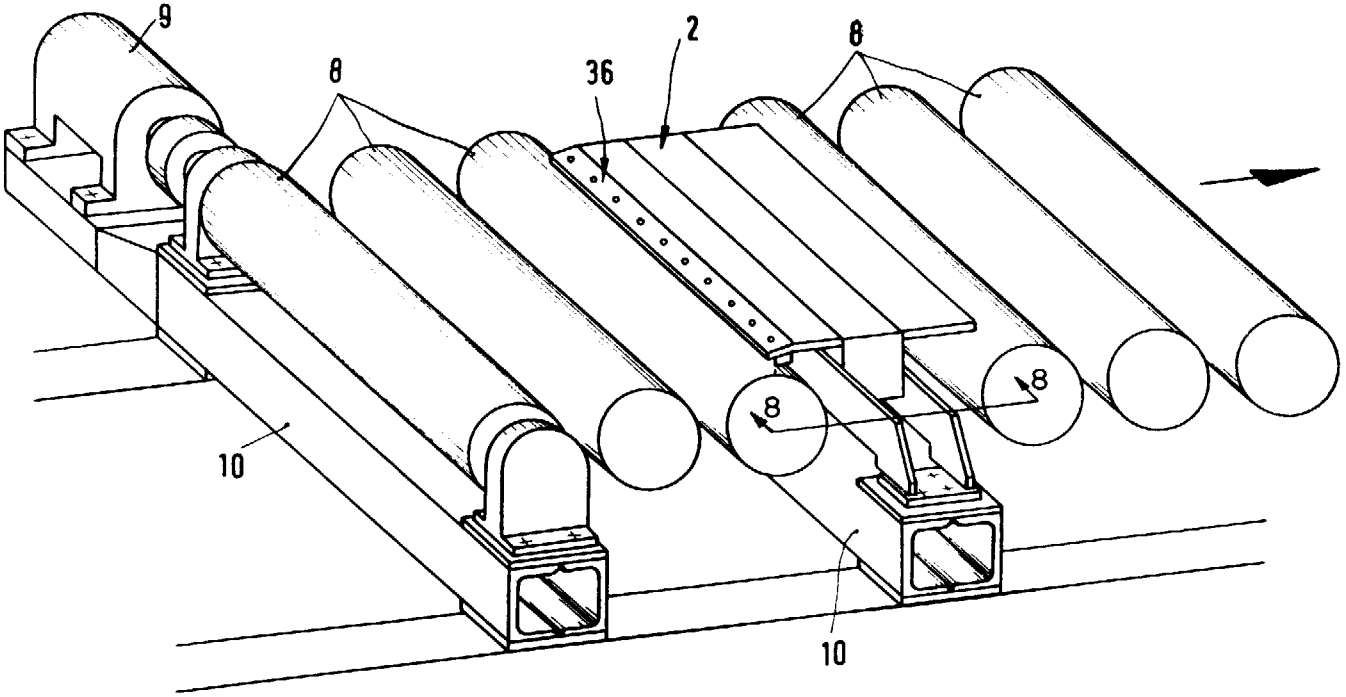
FIG. 7 shows a perspective view of a portion of a transport system according to the present invention wherein the linear drive element is constructed to have supplementary heat protection.

FIG. 7, like FIG. 3, is a perspective view of a section of a strip mill in the area of a linear drive element 2. The rollers of the roll table, which are driven by the electric motors 9, are designated by 8. For the sake of clarity, the electric motors are shown for one roller only. The rollers are mounted in pillow blocks, which are arranged on a section 10. As can be seen from this FIG. 7, in place of a roller, a linear drive element is placed on a section. The equipment according to the invention for generating the cushions (shown schematically) is designated by 36. It forms one constructional unit with a linear drive element. The flat material is transported in the direction of the arrow, i.e., perpendicularly to the axis of the rollers and perpendicularly to the linear drive element.

Figure 8:
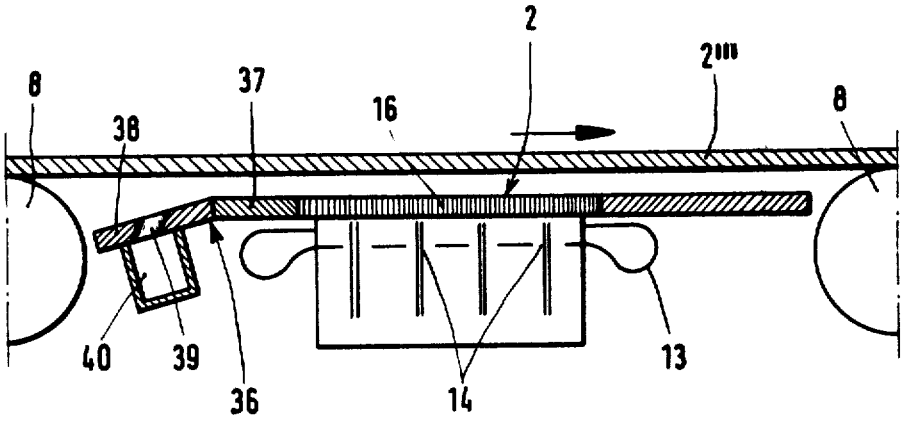
FIG. 8 shows on an enlarged scale a cross sectional view through the linear drive element shown in FIG. 7 as seen along line 8—8, together with a flat material passing thereover.

FIG. 8 shows a section through the linear drive element and the device according to the invention as shown in FIG. 7. The winding is designated by 13, and is situated in the grooves 14. The cover plate 16 is situated above the grooves. This cover plate consists of a highly wear-resistant material, which also serves as a magnetic and electric insulator. The linear drive element is arranged in such a way that the surface of this cover plate lies below the plane of the strip to be contacted by the rollers so as to form a gap. The linear drive element also includes a flange 36 which includes a covering portion 37 situated in the same plane as the cover plate 16 and a bevel portion 38 on the side of the linear drive element which faces the incoming flat material. The bevel portion 38 includes openings 39 which are supplied with the medium through the supply duct 40. The flange 36 forms an integral unit with the remainder of the linear drive element 2.

As can be seen from FIG. 8, the axes of the openings 39 in the bevel portion 38 are slanted with respect to the direction in which the flat material is transported in such a manner that the issuing medium is carried away by the flat material, while forming a cushion that builds up in the shape of a wedge. The direction of transportation of the flat material, labelled 2''', is indicated by an arrow. The linear drive element 2 and the flange 36, which as noted form one constructional unit, can be adjusted in height by means of a lifting/lowering device (not shown herein).

I claim:

1. A system for transporting a thin hot-rolled metallic strip through a strip mill towards a feed guide, said system including a roll table which includes a multiplicity of aligned rollers over which the thin hot-rolled metallic strip passes, the upper peripheries of said rollers forming a table plane and said roll table having a center line therethrough, at least one linear drive element positioned between at least one pair of rollers of said roll table, each linear drive element being located below the plane of said roll table, and a power supply means for said linear drive elements, said power supply means supplying current to said linear drive element(s) when a thin hot-rolled metallic strip passes over the roll table which is not centered over the center line of the roll table to cause the leading end of the thin metallic strip to move laterally towards the center line of the roll table.

2. The system as defined in claim 1 wherein each of the linear drive elements are aligned in parallel with the aligned rollers of the roll table.

3. The system as defined in claim 2 wherein a single linear drive element is positioned between a pair of rollers of said roll table so as to be centered with respect to said center line of said roll table.

4. The system as defined in claim 2 wherein two aligned linear drive elements are positioned between a pair of rollers of said roll table, one being positioned on one side of said center line of said roll table and the other being correspondingly positioned on the opposite side of said center line of said roll table.

5. The system as defined in claim 4 wherein two aligned linear drive elements are positioned between a multiplicity of a pair of rollers of said roll table.

6. The system as defined in claim 1 including sensor means for determining the position of a thin hot-rolled metallic strip on said roll table, said sensing means being connected to said power supply means for controlling the current fed to said linear drive element(s).

7. The system as defined in claim 6 wherein said sensor means comprises an opto-electric detector.

8. The system as defined in claim 1 including guide means positioned between each pair of rollers where a linear drive element is located, each said linear drive means being slidingly mounted on a guide means.

9. The system as defined in claim 1 wherein each linear drive element includes a heat-insulating cover plate located to protect it from the heat of a hot-rolled metallic strip passing thereover, said heat-insulating cover being made of a material which is wear resistant, magnetically insulating and electrically insulating.

10. The system as defined in claim 9 wherein each linear drive element includes grooves in which windings are located and a groove-closing wedge, and wherein means forming cooling passageways are formed between the groove-closing wedge and the respective cover plate.

11. The system as defined in claim 1 wherein said power supply means include a device for the capacitive compensation of the inductive idle power of each linear drive element.

12. A system for transporting a flat metallic material through a metallurgical plant which includes a roll table having a multiplicity of aligned rollers, the upper peripheries of which form a table plane, and a linear drive element positioned between one pair of rollers and below said table plane, said linear drive element including means for discharging a fluid medium upwardly towards the flat material on the incoming side thereof to act as a coolant cushion.

13. The system as defined in claim 12 wherein said fluid discharge means comprises a flange which includes upwardly-directed fluid discharge openings, said flange including a cover portion which extends in parallel with said table plane.

14. The system as defined in claim 13 wherein said flange includes a bevel portion which is slanted downwardly from said cover portion and wherein said fluid discharge openings are located in said bevel portion.

15. The system as defined in claim 14 wherein a fluid duct is located below the bevel portion of said flange of said linear drive element to supply fluid to said fluid discharge openings.

16. The system as defined in claim 15 wherein said linear drive element and said flange comprise a single unit which can be raised and lowered with respect to said table plane.

* * * * *